US008959930B2

(12) United States Patent
Lee et al.

(10) Patent No.: US 8,959,930 B2
(45) Date of Patent: Feb. 24, 2015

(54) METHOD AND APPARATUS FOR TREATING BOIL-OFF GAS IN AN LNG CARRIER HAVING A RELIQUEFACTION PLANT, AND LNG CARRIER HAVING SAID APPARATUS FOR TREATING BOIL-OFF GAS

(75) Inventors: Jung Han Lee, Gyeongsangnam-do (KR); Jin Yul Yu, Gyeongsangnam-do (KR); Dong Kyu Choi, Gyeongsangnam-do (KR); Hyun Ki Park, Gyeongsangnam-do (KR); Hyun Jin Kim, Gwangju (KR)

(73) Assignee: Daewoo Shipbuilding & Marine Engineering Co., Ltd., Seoul (KR)

( * ) Notice: Subject to any disclaimer, the term of this patent is extended or adjusted under 35 U.S.C. 154(b) by 1271 days.

(21) Appl. No.: 11/858,873

(22) Filed: Sep. 20, 2007

(65) Prior Publication Data

US 2008/0308175 A1 Dec. 18, 2008

(30) Foreign Application Priority Data

Jun. 15, 2007 (KR) ..... 10-2007-0058942

(51) Int. Cl.
*F17C 13/02* (2006.01)
*F17C 9/02* (2006.01)
(Continued)

(52) U.S. Cl.
CPC ..... *F17C 13/021* (2013.01); *F17C 13/02* (2013.01); *F17C 13/028* (2013.01);
(Continued)

(58) Field of Classification Search
CPC ..... F17C 7/04; F17C 13/02; F17C 13/021; F17C 13/028; F17C 2203/0629; F17C 5/007; F17C 2221/012; F17C 2221/032; F17C 2221/033; F17C 2221/014; F17C 2223/033; F17C 2223/0161; F17C 2223/03; F17C 2225/036; F17C 2250/061; F17C 2250/0434; F17C 2250/032; F17C 2250/043; F17C 2250/0443; F17C 2250/075; F17C 2250/0417; F17C 2250/0439; F17C 2250/0636; F17C 2250/0408; F17C 2250/0426; F17C 2205/0329; F17C 2205/0335; F17C 2205/0332; F17C 2205/0326; F17C 2205/0364; F17C 2265/065; F17C 2227/0135; F17C 2250/0615; F17C 2250/0621; F17C 2260/033; F17C 2260/02; Y02E 60/321
USPC ..... 62/50.1, 53.2, 49.2, 49.1, 48.1
See application file for complete search history.

(56) References Cited

U.S. PATENT DOCUMENTS 3,733,838 A * 5/1973 Delahunty ..... 62/48.2
3,763,658 A * 10/1973 Gaumer et al. ..... 62/612
(Continued)

FOREIGN PATENT DOCUMENTS

JP 54159720 A * 12/1979
KR 10-2000-0011346 2/2000
(Continued)

*Primary Examiner* — John F Pettitt
*Assistant Examiner* — Ignacio E Landeros
(74) *Attorney, Agent, or Firm* — Baker & Hostetler LLP

(57) ABSTRACT

Disclosed are a method and an apparatus for treating boil-off gas generated in an LNG storage tank of an LNG carrier for transporting LNG in a cryogenic liquid state, the LNG carrier having a boil-off gas reliquefaction plant, wherein an amount of boil-off gas corresponding to a treatment capacity of the reliquefaction plant among the total amount of boil-off gas generated during the voyage of the LNG carrier is discharged from the LNG storage tank and reliquefied by the reliquefaction plant. The boil-off gas treating method and apparatus can maintain an amount of boil-off gas discharged from an LNG storage tank at a constant level by storing in the LNG storage tank, instead of discharging and burning, surplus boil-off gas which has not been returned to the LNG storage tank through the reliquefaction plant among the total amount of boil-off gas generated in the LNG storage tank, and can prevent waste of boil-off gas and save energy by allowing an internal pressure of the LNG storage tank to be increased.

19 Claims, 12 Drawing Sheets

(51) Int. Cl.
*F17C 7/02* (2006.01)
*F17C 13/00* (2006.01)

(52) U.S. Cl.
CPC ..... *F17C 13/004* (2013.01); *F17C 2205/0142* (2013.01); *F17C 2205/0332* (2013.01); *F17C 2221/033* (2013.01); *F17C 2223/0161* (2013.01); *F17C 2223/0169* (2013.01); *F17C 2223/033* (2013.01); *F17C 2223/038* (2013.01); *F17C 2227/0135* (2013.01); *F17C 2227/0178* (2013.01); *F17C 2250/043* (2013.01); *F17C 2260/046* (2013.01); *F17C 2265/022* (2013.01); *F17C 2265/034* (2013.01); *F17C 2270/0105* (2013.01)
USPC ..... 62/49.2; 62/48.1; 62/50.1

(56) References Cited

U.S. PATENT DOCUMENTS

| | | | | | |
|---|---|---|---|---|---|
| 4,249,387 | A * | 2/1981 | Crowley | 62/48.2 |
| 5,586,513 | A | 12/1996 | Jean et al. | 114/74 A |
| 6,035,795 | A | 3/2000 | Dhellemmes et al. | 114/74 A |
| 6,378,722 | B1 | 4/2002 | Dhellemmes | 220/586 |
| 6,530,241 | B2 * | 3/2003 | Pozivil | 62/619 |
| 2002/0083719 | A1 * | 7/2002 | Hughes et al. | 62/49.1 |
| 2003/0000949 | A1 | 1/2003 | Dhellemmes | 220/4.12 |
| 2006/0053806 | A1 * | 3/2006 | Tassel | 62/48.1 |
| 2006/0156758 | A1 * | 7/2006 | An et al. | 62/613 |
| 2007/0068176 | A1 * | 3/2007 | Pozivil | 62/45.1 |

FOREIGN PATENT DOCUMENTS

| | | |
|---|---|---|
| KR | 10-2000-0011347 | 2/2000 |
| KR | 10-2001-0044709 | 6/2001 |
| KR | 10-2001-0092381 | 10/2001 |
| KR | 10-2003-0052347 | 6/2003 |
| KR | 10-2003-0053893 | 7/2003 |
| KR | 10-2003-0073974 | 9/2003 |
| KR | 10-2004-0046835 | 6/2004 |
| KR | 10-2004-0046836 | 6/2004 |
| KR | 10-0499710 | 6/2005 |
| KR | 10-2005-0089922 | 9/2005 |
| KR | 10-0644217 | 11/2006 |
| KR | 20-2006-0000158 | 12/2006 |

* cited by examiner

METHOD AND APPARATUS FOR TREATING BOIL-OFF GAS IN AN LNG CARRIER HAVING A RELIQUEFACTION PLANT, AND LNG CARRIER HAVING SAID APPARATUS FOR TREATING BOIL-OFF GAS

CROSS-REFERENCE TO RELATED APPLICATIONS

This application claims priority to Korean Patent Application No. 10-2007-0058942, filed Jun. 15, 2007, which is hereby incorporated by reference in its entirety.

BACKGROUND OF THE INVENTION

The present invention relates to a method for treating boil-off gas in an LNG carrier having a reliquefaction apparatus, and more particularly, to a method and an apparatus for treating boil-off gas which can prevent waste of boil-off gas and save energy by storing in an LNG storage tank, instead of discharging and burning, surplus boil-off gas which has not been returned to the LNG storage tank through a reliquefaction plant among the total amount of boil-off gas generated in the LNG storage tank.

Generally, natural Gas (NG) is turned into a liquid (also called liquefied natural gas or LNG) in a liquefaction plant, transported over long distances by an LNG carrier, and regasified by passing a floating storage and regasification unit (FSRU) or an unloading terminal on land to be supplied to consumers.

As liquefaction of natural gas occurs at a cryogenic temperature of approximately −163° C. at ambient pressure, LNG is likely to be vaporized even when the temperature of the LNG is slightly higher than −163° C. at ambient pressure. Though an LNG storage tank of an LNG carrier is thermally insulated, as heat is continually transmitted from the outside to the LNG in the LNG storage tank, the LNG is continually vaporized and boil-off gas (BOG) is generated in the LNG storage tank during the transportation of LNG by the LNG carrier.

If boil-off gas is generated in an LNG storage tank as described above, the pressure of the LNG storage tank is increased and becomes dangerous.

Conventionally, if the pressure of an LNG storage tank is increased beyond a set pressure, boil-off gas was discharged to the outside of the LNG storage tank and used as a fuel for propulsion of an LNG carrier, so as to maintain the pressure of the LNG storage tank at a safe level. However, a steam turbine propulsion system driven by the steam generated in a boiler by burning the boil-off gas generated in an LNG storage tank has a problem of low propulsion efficiency.

Also, a dual fuel diesel electric propulsion system, which uses the boil-off gas generated in an LNG storage tank as a fuel for a diesel engine after compressing the boil-off gas, has higher propulsion efficiency than the steam turbine propulsion system, but has difficulty in maintenance due to complicated integration of a medium-speed diesel engine and an electric propulsion unit in the system. In addition, this system, which must supply boil-off gas as a fuel, is forced to employ a gas compression method which requires higher installation and operational costs than a liquid compression method.

Further, such a conventional method using boil-off gas as a fuel for propulsion fails to achieve the efficiency of a two-stroke slow-speed diesel engine, which is used in ordinary ships.

Furthermore, the conventional method has such another problem that, in case the amount of boil-off gas generated in an LNG storage tank exceeds the capacity of a propulsion system, additional equipment such as a gas combustion unit is needed to treat surplus boil-off gas.

On the other hand, there is another method of maintaining a pressure of an LNG storage tank at a safe level. If the pressure of the LNG storage tank is increased beyond a set pressure, boil-off gas is discharged to the outside of the LNG storage tank and reliquefied in a reliquefaction plant and then returned to the LNG storage tank.

FIG. 1 shows a conceptual diagram for explaining a method for treating boil-off gas in an LNG carrier having a reliquefaction plant.

As shown in FIG. 1, the LNG carrier having a reliquefaction plant comprises an LNG storage tank (1) for storing LNG therein, a boil-off gas compression unit (110) for compressing boil-off gas generated in the LNG storage tank (1), a condenser (120) for condensing the compressed boil-off gas by exchanging heat with a refrigerant, and a refrigerant system (130) for providing cold heat for condensing boil-off gas in the condenser (120). Here, the boil-off gas compression unit (110), the condenser (120) and the refrigerant system (130) constitute the reliquefaction plant.

Though the reliquefaction plant is provided on the LNG carrier, a treatment capacity of the reliquefaction plant is limited, and in case an amount of boil-off gas greater than the treatment capacity of the reliquefaction plant is generated, surplus boil-off gas must be burned and wasted. To burn surplus boil-off gas, a conventional LNG carrier has a gas combustion unit (103), and the surplus boil-off gas is heated in a gas heater (105) to an appropriate temperature and then supplied to the gas combustion unit (103) to be burned and wasted.

FIG. 2 illustrates a graph showing changes over time in an internal pressure of an LNG storage tank and in an amount of boil-off gas generated in the LNG storage tank according to a conventional boil-off gas treating method.

As illustrated in FIG. 2, in case a constant internal pressure of the LNG storage tank (1) is maintained at approximately 106 kPa, a large amount of boil-off gas is discharged to the outside of the LNG storage tank (1) for 3 to 4 days at the beginning of a loaded voyage of the LNG carrier, and an amount of boil-off gas discharged becomes stable (approximately 5,643 kg/hr in FIG. 2) after 3 to 4 days from the beginning of the loaded voyage. Conventionally, a treatment capacity of a reliquefaction plant was determined based on this stable amount of boil-off gas discharged.

Since a treatment capacity of a reliquefaction plant is limited, surplus boil-off gas beyond a treatment capacity of a reliquefaction plant is generated for 3 to 4 days at the beginning of a loaded voyage of an LNG carrier. Such surplus boil-off gas, as stated above, is all burned and wasted. Accordingly, the prior art has a problem that large quantities of surplus boil-off gas, which amount to 55 tons (see oblique lines in FIG. 2), are burned and wasted.

In a case of an LNG carrier having a capacity of 150,000 $m^3$, the quantity of boil-off gas burnt as described above amounts to 1500 to 2000 tons per year, which cost about 700,000 USD. Further, burning of boil-off gas raises a problem of environmental pollution.

In addition, the prior art has such other problems that since a reliquefaction plant and a gas combustion unit (103) should be operated together at the beginning of a loaded voyage of an LNG carrier, additional equipment such as a gas combustion unit (103) or a gas heater (105) is needed for treating the surplus boil-off gas, and that a large amount of energy is consumed due to operation of the gas combustion unit (103).

Korean Patent Laid-Open Publication Nos. KR 2001-0014021, KR 2001-0014033, KR 2001-0083920, KR 2001-0082235, and KR 2004-0015294 disclose techniques of suppressing the generation of boil-off gas in an LNG storage tank by maintaining the pressure of the boil-off gas in the LNG storage tank at a high pressure of approximately 200 bar (gauge pressure) without installing a thermal insulation wall in the LNG storage tank. However, this LNG storage tank must have a significantly high thickness to store boil-off gas having a high pressure of approximately 200 bar, and consequently it has problems of increasing manufacturing costs and requiring additional equipment such as a high-pressure pump, to maintain the pressure of boil-off gas at approximately 200 bar.

As stated above, a method for treating boil-off gas in an LNG carrier according to the prior art, which maintains an internal pressure of an LNG storage tank at a constant level and allows generation of boil-off gas during transportation of a cryogenic liquid, has a problem of consuming a large amount of boil-off gas or having to install additional equipment such as a reliquefaction plant and a gas combustion unit.

In addition, unlike a case of transporting a cryogenic liquid at a low atmospheric pressure, a method of transporting a cryogenic liquid using a storage tank, such as a pressure tank, which can withstand a high pressure at a somewhat high temperature, does not need to treat or waste boil-off gas, but has problems that the size of the tank is limited and that high manufacturing costs are required.

SUMMARY OF THE INVENTION

The present invention has been made in consideration of the situations mentioned above, and is to provide a method and an apparatus for treating boil-off gas which can maintain an amount of boil-off gas discharged from an LNG storage tank at a constant level by storing in the LNG storage tank, instead of discharging and burning, surplus boil-off gas which has not been returned to the LNG storage tank through a reliquefaction plant among the total amount of boil-off gas generated in the LNG storage tank, and which can prevent waste of boil-off gas and save energy by allowing a pressure in the LNG storage tank to be increased.

Figure 1:
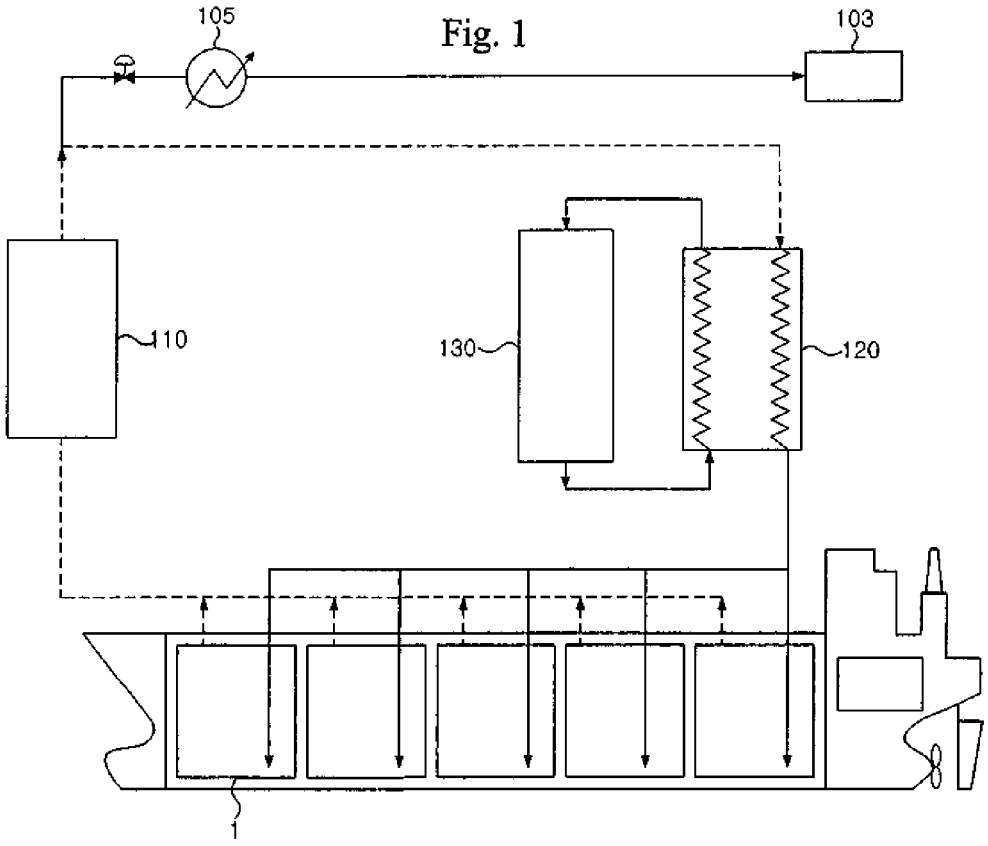
FIG. 1 is a conceptual diagram for explaining a method for treating boil-off gas in an LNG carrier having a reliquefaction plant according to the prior art.
Figure 2:
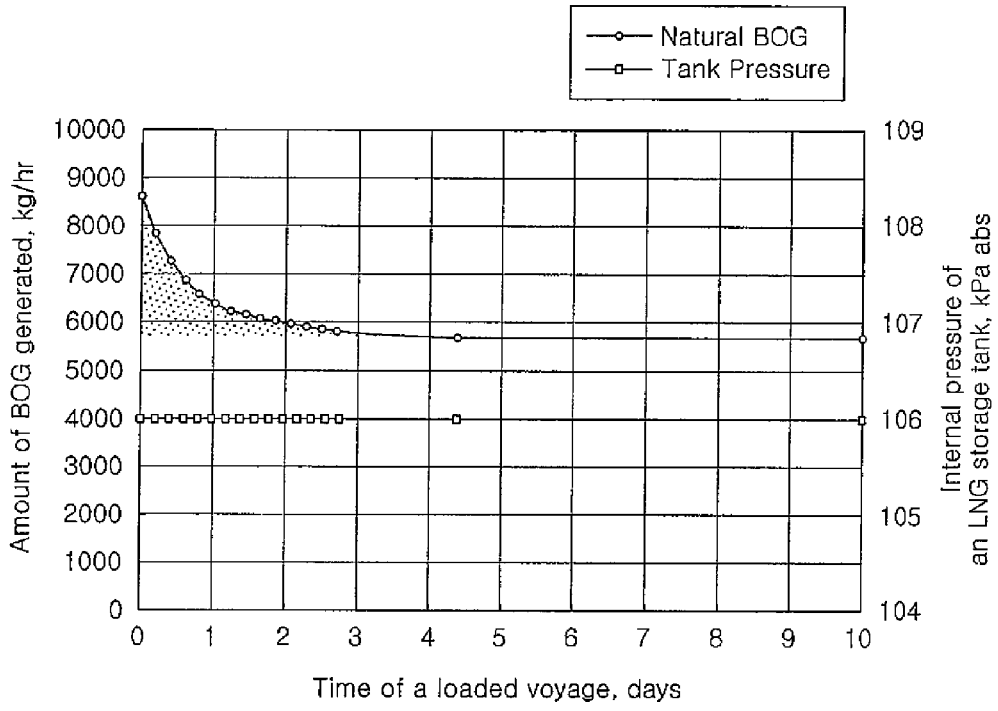
FIG. 2 is a graph showing changes over time in an internal pressure of an LNG storage tank and in an amount of boil-off gas generated in the LNG storage tank according to the boil-off gas treating method shown in FIG. 1.

The following is a description of the reference signs related to main parts in the drawings:

1 LNG storage tank for an LNG carrier
2 LNG storage tank for an unloading terminal
3*a* high-pressure compressor
3*b* low-pressure compressor
4 recondenser
5 vaporizer
11 LNG pump
13 LNG spray
21 boil-off gas (BOG) injection nozzle
23 boil-off gas (BOG) compressor
110 boil-off gas (BOG) compression unit
120 condenser
130 refrigerant system
P high-pressure pump

DETAILED DESCRIPTION OF ILLUSTRATIVE EMBODIMENTS

An embodiment of the present invention provides a method for treating boil-off gas generated in an LNG storage tank of an LNG carrier for transporting LNG in a cryogenic liquid state, the LNG carrier having a boil-off gas reliquefaction plant, wherein an amount of boil-off gas, which corresponds to a treatment capacity of the reliquefaction plant, among the total amount of boil-off gas generated during the voyage of the LNG carrier, is discharged from the LNG storage tank and reliquefied by the reliquefaction plant.

Another embodiment of the present invention provides a method for treating boil-off gas generated in an LNG storage tank of an LNG carrier for transporting LNG in a cryogenic liquid state, the LNG carrier having a boil-off gas reliquefaction plant, wherein an amount of boil-off gas which has been discharged from the LNG storage tank among the total amount of boil-off gas generated during the voyage of the LNG carrier is maintained at a constant level, and a pressure in the LNG storage tank is allowed to be increased due to the boil-off gas which has not been discharged from the LNG storage tank among the total amount of boil-off gas generated.

In addition, another embodiment of the present invention provides an apparatus for treating boil-off gas generated in an LNG storage tank of an LNG carrier for transporting LNG in a cryogenic liquid state, the apparatus comprising: a controller for controlling a BOG discharging means so as to discharge from the LNG storage tank an amount of the boil-off gas corresponding to a treatment capacity of the reliquefaction plant among the total amount of boil-off gas generated during the voyage of the LNG carrier.

Further, another embodiment of the present invention provides an LNG carrier for transporting LNG in a cryogenic liquid state with the LNG stored in an LNG storage tank, the LNG carrier comprising: a boil-off gas treating apparatus including a boil-off gas reliquefaction plant, and a controller for controlling a BOG discharging means so as to discharge from the LNG storage tank an amount of the boil-off gas corresponding to a treatment capacity of the reliquefaction plant among the total amount of boil-off gas generated during the voyage of the LNG carrier; and an LNG storage tank whose internal pressure is allowed to be increased due to the boil-off gas which has not been discharged from the LNG storage tank among the total amount of the boil-off gas generated during the voyage of the LNG carrier.

The present invention relates to a somewhat high-pressure (near ambient pressure) tank for transporting LNG in a cryogenic liquid state, characterized in that some degree of change in the internal pressure of the tank is allowed during the transportation of LNG.

One embodiment of the present invention provides, in an LNG carrier having boil-off gas treating means for treating boil-off gas generated in an LNG storage tank, an LNG carrier characterized in that the vapor pressure in the LNG storage tank and the temperature of the LNG are allowed to be increased during the transportation of the LNG in the LNG storage tank.

In general, the following methods are known as means for treating boil-off gas: using the boil-off gas generated from an LNG storage tank for a boiler (e.g. a steam turbine propulsion boiler); using the boil-off gas as a fuel of a gas engine such as a DFDE and MEGI; using the boil-off gas for a gas turbine; and reliquefying the boil-off gas and returning the reliquefied boil-off gas to the LNG storage tank (see Korean Patent Laid-Open Publication No. 2004-0046836, Korean Patent Registration Nos. 0489804 and 0441857, and Korean Utility Model Publication No. 2006-0000158). These methods has problems of generation of excessive boil-off gas exceeding a treatment capacity of a general boil-off gas treating means (e.g. after LNG is loaded), or waste of boil-off gas by a boil-off gas combustion means such as a gas combustion unit (GCU) when the boil-off gas cannot be treated by the boil-off gas treating means, e.g. when an LNG carrier enters or leaves port and when it passes through a canal.

The present invention has an advantage of eliminating such waste of boil-off gas by improving flexibility in boil-off gas treatment. The LNG carrier according to the present invention may not require a GCU, or may require a GCU for improving flexibility in treating or managing boil-off gas in an emergency.

The LNG carrier of the present invention is equipped with boil-off gas treating means such as a boiler, a reliquefaction apparatus, and a gas engine for treating the boil-off gas generated from an LNG storage tank by discharging the boil-off gas to the outside of the LNG storage tank.

Another embodiment of the present invention provides, in a method for controlling a safety valve provided at an upper portion of an LNG storage tank for an LNG carrier, a method for opening and closing the safety valve characterized in that the set pressure of the safety valve during the loading of LNG in the LNG storage tank differs from the set pressure of the safety valve during the voyage of the LNG carrier. The present invention also provides a safety valve, an LNG storage tank, and an LNG carrier having said feature.

Conventionally, the pressure in an LNG storage tank is safely managed by installing a safety valve at an upper portion of the LNG storage tank for an LNG carrier which transports LNG in a cryogenic liquid state. Some known methods of safely managing the pressure in an LNG storage tank are: safeguarding against a possible explosion of an LNG storage tank by means of a safety valve; and treating the boil-off gas generated from the LNG storage tank, after LNG is loaded, by the above-mentioned methods including using the boil-off gas for a boiler (e.g. a steam turbine propulsion boiler), using the boil-off gas as a fuel of a gas engine such as a DFDE and MEGI, using the boil-off gas for a gas turbine, and reliquefying the boil-off gas and returning the reliquefied boil-off gas to the LNG storage tank. These methods are forced to generate excessive boil-off gas which exceeds a treatment capacity of a general boil-off gas treating means (e.g. after LNG is loaded in an LNG carrier), or to waste boil-off gas by a boil-off gas combustion means such as a GCU when an LNG carrier enters or leaves port, and when it passes through a canal. The pressure in an LNG storage tank for an LNG carrier is maintained within a predetermined range by such methods.

In such an LNG carrier, when the set value of a safety valve is 0.25 bar, a maximum of about 98% of the full capacity of an LNG storage tank is loaded with LNG and the remaining about 2% is left as an empty space. If more than 98% of the full capacity of an LNG storage tank is loaded with LNG, when the pressure of the LNG storage tank reaches 0.25 bar, the LNG in the LNG storage tank may overflow from the dome at an upper portion thereof. As shown in another embodiment of the present invention, if the pressure of LNG in an the LNG storage tank is continually allowed to be increased after the LNG is loaded, even when a small amount of LNG is loaded, the LNG in the LNG storage tank may overflow due to the expansion of the LNG caused by an increase in the temperature of the LNG at the set pressure of the safety valve according to the present invention. For example, it has been found that, when the vapor pressure in an LNG storage tank is 0.7 bar, even if 97% of the full capacity of the LNG storage tank is loaded with LNG, the LNG in the LNG storage tank may overflow. It follows that the amount of LNG to be loaded should be reduced.

Accordingly, instead of uniformly fixing the set pressure of a safety valve provided at an upper portion of an LNG storage tank to a somewhat high pressure near ambient pressure, it is possible to reduce waste of boil-off gas or increase flexibility in treatment of boil-off gas without reducing an initial LNG load, by fixing the set pressure of a safety valve to a lower pressure, e.g. 0.25 bar, as in an existing LNG carrier, during loading of LNG, and then increasing the set pressure of the safety valve, as in another embodiment of the present invention, when the amount of LNG in the LNG storage tank is reduced by using some boil-off gas (e.g. using the boil-off gas as a fuel of a boiler or engine) after the LNG carrier starts voyage. The present invention, if applied to an LNG carrier equipped with boil-off gas treating means (e.g. a boiler, a reliquefaction apparatus, or a gas engine) for treating the boil-off gas generated from an LNG storage tank by discharging the boil-off gas to the outside of the LNG storage tank, has a great effect in eliminating waste of boil-off gas.

Consequently, in the present invention, the set pressure of a safety valve is increased after the amount of LNG in an LNG storage tank is reduced by discharging the boil-off gas generated in the LNG storage tank to the outside thereof: preferably the set pressure during the loading of LNG is set at 0.25 bar or lower; and the pressure during the voyage of the LNG carrier is set from higher than 0.25 bar to 2 bar, and more preferably, the set pressure during the voyage of the LNG carrier is set from higher than 0.25 bar to 0.7 bar. Here, the set pressure of a safety valve during the voyage of the LNG carrier may be increased gradually, e.g. from 0.4 bar to 0.7 bar, according to the amount of boil-off gas used according to the voyage conditions.

In the present invention, the expression "during the voyage of an LNG carrier" means when the volume of LNG in an LNG storage tank is somewhat reduced by use of some boil-off gas after the LNG carrier starts voyage with LNG loaded therein. For example, it is desirable to set the set pressure of a safety valve at 0.25 bar when the volume of LNG in an LNG storage tank is 98.5%, at 0.4 bar when the volume of LNG is 98.0%, 0.5 bar when the volume of LNG is 97.7%, and 0.7 bar when the volume of LNG is 97.1%.

Another embodiment of the present invention provides an LNG storage tank for an LNG carrier for transporting LNG in a cryogenic liquid state, characterized in that the set pressure of a safety valve provided at an upper portion of the LNG storage tank is set from higher than 0.25 bar to 2 bar, preferably from higher than 0.25 bar to 0.7 bar, and more preferably approximately 0.7 bar. The present invention also provides a method for setting a safety valve, an LNG storage tank, and an LNG carrier having said technical feature.

As this method has problems of great waste of boil-off gas and increase of manufacturing costs of an LNG carrier, the present invention solves said problems by increasing the set pressure value of a safety valve of an LNG storage tank, thereby allowing increases in the internal pressure of the LNG storage tank and in the temperature of the LNG in the LNG storage tank during the voyage of an LNG carrier from after loading of LNG to before unloading of LNG.

Another embodiment of the present invention provides an LNG storage tank for an LNG carrier for transporting LNG in a cryogenic liquid state, characterized in that the vapor pressure in the LNG storage tank is controlled within near-ambient pressure, and that the vapor pressure in the LNG storage tank and the pressure of the LNG in the LNG storage tank are allowed to be increased during the transportation of the LNG. The LNG storage tank is also characterized in that the vapor pressure in the LNG storage tank ranges from higher than 0.25 bar to 2 bar, preferably from higher than 0.25 bar to 0.7 bar, and more preferably, approximately 0.7 bar. In addition, the LNG storage tank is characterized in that the boil-off gas at an upper portion of the LNG storage tank is mixed with the LNG at a lower portion of the LNG storage tank so as to maintain a uniform temperature distribution in the LNG storage tank. On one hand, as more LNG is likely to be vaporized when the temperature of one part of the LNG storage tank is higher than the temperature of the other part thereof, it is desirable to maintain a uniform temperature distribution of the LNG or boil-off gas in the LNG storage tank. On the other hand, as the boil-off gas at an upper portion of the LNG storage tank has a smaller heat capacity than the LNG at a lower portion of the LNG storage tank, a local sharp increase in the temperature at an upper portion of the LNG storage tank due to the heat ingress from the outside into the LNG storage tank may result in a sharp increase in the internal pressure of the LNG storage tank. The sharp increase in the internal pressure of the LNG storage tank can be prevented by mixing the boil-off gas at an upper portion of the LNG storage tank with the LNG at a lower portion of the LNG storage tank.

Also, according to another embodiment of the present invention, the vapor pressure in an LNG storage tank for an LNG carrier can be controlled to match the pressure in an LNG storage tank for receiving the LNG at an LNG terminal. For example, the pressure in the LNG storage tank for an LNG carrier can match the pressure of the LNG storage tank for receiving the LNG by continually increasing the pressure in the LNG storage tank for an LNG carrier during the voyage of the LNG carrier, in case the pressure in the LNG storage tank to receive LNG therein at an LNG unloading terminal, an LNG-RV, or a FSRU is high (e.g. approximately 0.4 to 0.7 bar), and by reducing the waste of boil-off gas by using the flexibility in boil-off gas treatment according to the present invention, in case the pressure in the LNG storage thank for receiving LNG therein at an LNG unloading terminal is low (approximately 0.2 bar) as in the prior art.

In addition, another embodiment of the present invention provides a method for transporting LNG in a cryogenic liquid state having said technical feature, and an LNG carrier having said LNG storage tank.

In particular, another embodiment of the present invention provides a membrane LNG storage tank having a somewhat high pressure near ambient pressure to transport LNG in a cryogenic liquid state, characterized in that some degree of change in the pressure in the LNG storage is allowed during the transportation of LNG. The membrane tank according to the present invention is a cargo space of an LNG tank as defined in IGC Code (2000). More specifically, a membrane tank is a non-self-supporting tank having a thermal insulation wall formed in a body and having a membrane formed at an upper portion of the tank. In the present application, the membrane tank is used to include a semi-membrane tank.

Some examples of the membrane tank are GTT NO 96-2 and Mark III as described below, and tanks as described in Korean Patent Nos. 499710 and 644217.

A membrane tank can be designed to withstand the pressure up to 0.7 bar (gauge pressure) by reinforcing the tank, but it is generally prescribed that a membrane tank should be designed to have the pressure not exceeding 0.25 bar. All the existing membrane tanks comply with this regulation, and are managed so that the vapor pressure in the tank is 0.25 bar or lower, and that the temperature and pressure of the LNG are almost constant during the voyage. On the contrary, the present invention is characterized in that at the pressure of higher than 0.25 bar, preferably from higher than 0.25 bar to 2 bar or lower, and more preferably from higher than 0.25 bar to 0.7 bar or lower, the pressure in the tank and the temperature of the LNG are allowed to be increased. Also, the method for treating boil-off gas by using the LNG storage tank according to the present invention is characterized by maintaining a uniform temperature distribution in the LNG storage tank.

According to another embodiment of the present invention, the present invention provides a large LNG carrier, or an LNG carrier having an LNG storage capacity of preferably 100,000 $m^3$ or more. In case of an LNG carrier having a large capacity, to manufacture an LNG storage tank into a high-pressure tank, the manufacturing costs are sharply increased due to an increase in the thickness of the tank. In case of manufacturing a tank having a relative pressure of approximately 1 bar, near atmospheric pressure, as in the present invention, the manufacturing costs are not sharply increased, and also the tank can transport LNG, substantially withstanding the pressure generated by boil-off gas and not treating the boil-off gas.

The LNG storage tank according to the present invention is applicable to an LNG carrier, an LNG floating storage and regasification unit (FSRU), an unloading terminal on land, and an LNG regasification vessel (LNG-RV), etc. The LNG storage tank has advantages of reducing waste of boil-off gas by allowing increase in the pressure and temperature in the LNG storage tank and solving a problem of treating boil-off gas, and of increasing flexibility in LNG treatment, such as transporting and storing LNG, because it is possible to store LNG in said all kinds of LNG storage tanks for a long time, taking into account LNG demand.

The embodiments of the present invention will be described mainly by putting an example of an LNG storage tank applicable to an LNG carrier.

Figure 3:
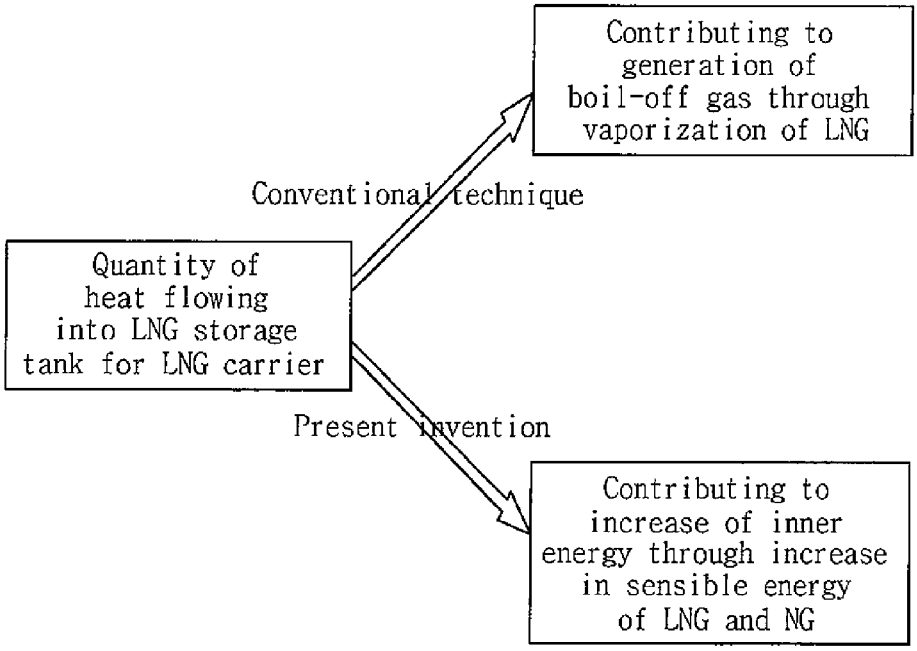
FIG. 3 is a schematic view illustrating the concept of absorption of heat ingress into an LNG storage tank for an LNG carrier according to the preferred embodiment of the present invention.

FIG. 3 shows a concept of the absorption of heat ingress into an LNG storage tank for an LNG carrier according to the present invention. In the prior art, the pressure in an LNG storage tank for an LNG carrier is maintained within a predetermined range, and consequently, most of the heat ingress from the outside into the LNG storage tank makes contribution to generation of boil-off gas, all of which should be treated in the LNG carrier. On the contrary, according to the present invention, the pressure in an LNG storage tank for an LNG carrier is allowed to be increased, thereby increasing saturation temperature, and accordingly, most of the heat is absorbed by sensible heat increase of LNG or natural gas (NG) in the LNG storage tank, which is caused by the increase in saturation temperature, thereby noticeably reducing generation of boil-off gas. For example, when the pressure of the LNG storage tank for an LNG carrier is increased to 0.7 bar from an initial pressure of 0.06 bar, the saturation temperature is increased by approximately 6□.

Figure 4:
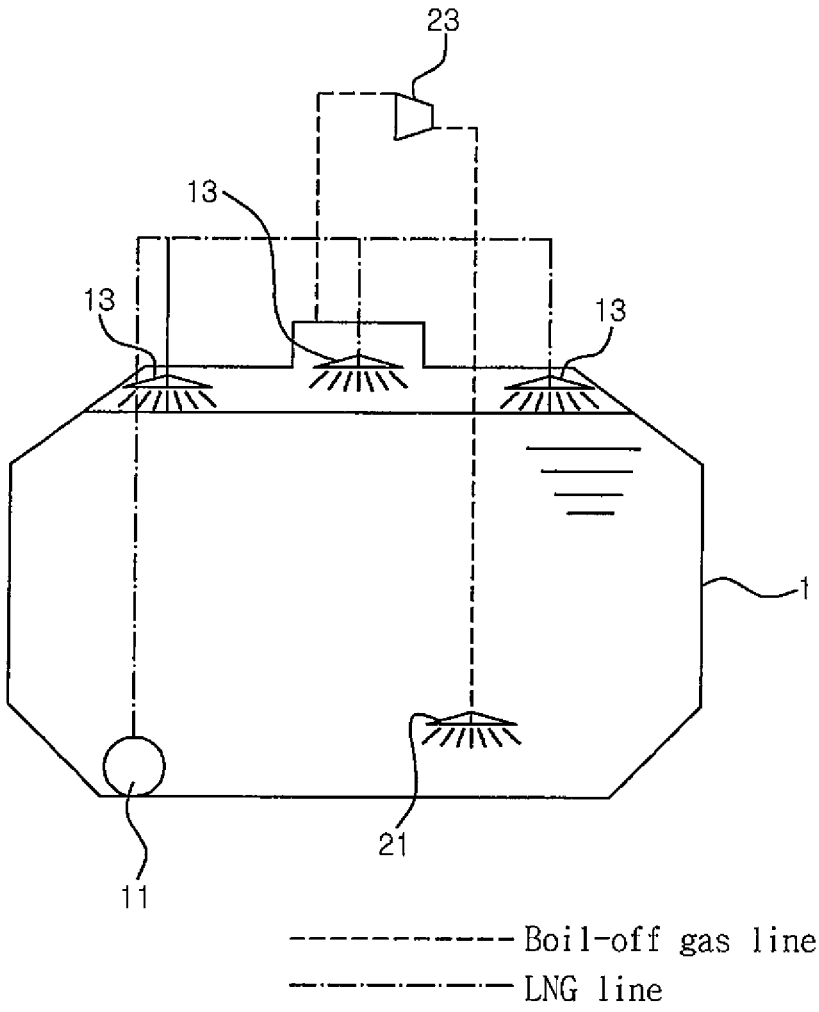
FIG. 4 is a schematic diagram illustrating an LNG storage tank for an LNG carrier according to the preferred embodiment of the present invention.

FIG. 4 schematically illustrates an LNG storage tank for an LNG carrier according to the preferred embodiment of the present invention. In an LNG storage tank (1) for an LNG carrier which has a thermal insulation wall formed therein, in case LNG is normally loaded, the pressure in the LNG storage tank (1) is approximately 0.06 bar (gauge pressure) when the LNG carrier starts voyage, and the pressure is gradually increased due to the generation of boil-off gas during the voyage of the LNG carrier. For example, the pressure in the LNG storage tank (1) for an LNG carrier is 0.06 bar right after LNG is loaded into the LNG storage tank (1) at a location where LNG is produced, and can be increased up to 0.7 bar when the LNG carrier arrives at a destination after about 15-20 days of voyage.

With regard to temperature, LNG which generally contains many impurities has a lower boiling point than a pure methane liquid. The pure methane has a boiling point of about −161° C. at 0.06 bar, and LNG for transportation which contains impurities such as nitrogen, ethane, etc., has a boiling point of approximately −163° C. Based on pure methane, LNG in an LNG storage tank after being loaded into the LNG storage tank has a temperature of approximately −161° C. at 0.06 bar. If the vapor pressure in the LNG storage tank is controlled to be 0.25 bar, taking into account the transportation distance and the consumption of boil-off gas, the temperature of the LNG is increased to approximately −159° C.; if the vapor pressure in the LNG storage tank is controlled to be 0.7 bar, the temperature of the LNG is increased to approximately −155° C.; if the vapor pressure in the LNG storage tank is controlled to be 2 bar, the temperature of the LNG is increased up to approximately −146° C.

The LNG storage tank for an LNG carrier according to the present invention comprises a thermal insulation wall and is designed by taking into account the pressure increase caused by the generation of boil-off gas. That is, the LNG storage tank is designed to have sufficient strength to withstand the pressure increase caused by the generation of boil-off gas. Accordingly, the boil-off gas generated in the LNG storage tank (1) for an LNG carrier during the voyage of the LNG carrier is accumulated in the LNG storage tank (1).

For example, the LNG storage tank (1) for an LNG carrier according to the embodiment of the present invention preferably comprises a thermal insulation wall, and is designed to withstand the pressure from higher than 0.25 bar to 2 bar (gauge pressure), and more preferably, the pressure of 0.6 to 1.5 bar (gauge pressure). Taking into account the transportation distance of LNG and the current IGC Code, it is desirable to design the LNG storage tank to withstand the pressure from higher than 0.25 bar to 0.7 bar, particularly, approximately 0.7 bar. However, making the pressure too low is not desirable because the transportation distance of LNG becomes too short, and also making the pressure too high causes difficulty in manufacturing the LNG storage tank.

In addition, since the LNG storage tank (1) for an LNG carrier according to the present invention can be sufficiently embodied by designing the LNG storage tank (1) to have a great thickness during an initial design, or simply by suitably reinforcing an existing general LNG storage tank for an LNG carrier through addition of a stiffener thereto without making a big change in the design of the existing LNG storage tank, it is economical in view of manufacturing costs.

Various conventional LNG storage tanks for LNG carriers with a thermal insulation wall therein are known in the related art as described below. Accordingly, the thermal insulation wall is omitted from FIG. 3.

An LNG storage tank installed in an LNG carrier can be classified into an independent-type tank and a membrane-type tank, and is described in detail below.

GTT NO 96-2 and GTT Mark III in Table 1 below was renamed from GT and TGZ, respectively, when the Gaz Transport (GT) Corporation and Technigaz (TGZ) corporation was incorporated into GTT (Gaztransport & Technigaz) Corporation in 1995.

TABLE 1

Classification of LNG Storage Tanks

| | Membrane Type | | Independent Type | |
|---|---|---|---|---|
| | GTT | | | |
| | Mark III | GTT No. 96-2 | MOSS | IHI-SPB |
| Tank Material - Thickness | SUS 304L - 1.2 mm | Invar Steel - 0.7 mm | Al Alloyed Steel (5083) - 50 mm | Al Alloyed Steel (5083) - Max. 30 mm |
| Heat Dissipation Material - Thickness | Reinforced Polyurethane Foam - 250 mm | Plywood Box + Perlite - 530 mm | Polyurethane Foam - 250 mm | Polyurethane Foam - 250 mm |

GT type and TGZ type tanks are disclosed in U.S. Pat. No. 6,035,795, U.S. Pat. No. 6,378,722, and U.S. Pat. No. 5,586,513, US Patent Publication US 2003-0000949, and Korean Patent Laid-Open Publication Nos. KR 2000-0011347, and KR 2000-0011346. Korean Patent Nos. 499710 and 0644217 disclose thermal insulation walls embodied as other concepts.

The prior art discloses LNG storage tanks for LNG carriers having various types of thermal insulation walls, which are to suppress generation of boil-off gas as much as possible.

The present invention can be applied to conventional LNG storage tanks for LNG carriers having various types of thermal insulation functions as stated above. Most of these LNG storage tanks for LNG carriers are designed to withstand the pressure of 0.25 bar or lower, and consume the boil-off gas generated in the LNG storage tanks as a fuel for propulsion of the LNG carriers or reliquefy the boil-off gas to maintain the pressure in the LNG storage tank at 0.2 bar or lower, e.g. 0.1 bar, and burn part or all of the boil-off gas if the pressure in the LNG storage tank is increased beyond the value. In addition, these LNG storage tanks have a safety valve therein, and if the LNG storage tanks fail to control the pressure therein as stated above, boil-off gas is discharged to the outside of the LNG storage tanks through the safety valve (mostly, having a set pressure of 0.25 bar).

On the contrary, according to the present invention, in case the pressure at an upper portion, usually a dome, of the LNG storage tank shown in FIG. 4 is increased due to boil-off gas generated from the LNG storage tank during the voyage of the LNG carrier, a safety valve (not illustrated) controls the discharge of the boil-off gas. In the present invention, the pressure of the safety valve is set from higher than 0.25 bar to 2 bar, preferably from higher than 0.25 bar to 0.7 bar, and more preferably approximately 0.7 bar.

In addition, the LNG storage tank according to the present invention is configured to reduce the pressure in the LNG storage tank by reducing the local increase in temperature and pressure of the LNG storage tank. The LNG storage tank maintains a uniform temperature distribution thereof by spraying the LNG, having a lower temperature, at a lower portion of the LNG storage tank, toward the boil-off gas, having a higher temperature, at an upper portion of the LNG storage tank, and by injecting the boil-off gas, having a higher temperature, at an upper portion of the LNG storage tank, toward the LNG, having a lower temperature, at a lower portion of the LNG storage tank.

In FIG. 4, the LNG storage tank (1) for an LNG carrier is provided at a lower portion thereof with an LNG pump (11) and a boil-off gas injection nozzle (21), and at an upper portion thereof with an LNG spray (13) and a boil-off gas compressor (23). The LNG pump (11) and the boil-off gas compressor (23) can be installed at an upper or lower portion of the LNG storage tank. The LNG, having a lower temperature, at a lower portion of the LNG storage tank (1) is supplied to the LNG spray (13) provided at an upper portion of the LNG storage tank by the LNG pump (11) and then sprayed toward the upper portion of the LNG storage tank (1), which has a higher temperature, and the boil-off gas, having a higher temperature, at an upper portion of the LNG storage tank (1) is supplied to the boil-off gas injection nozzle (21) provided at a lower portion of the LNG storage tank (1) by the boil-off gas compressor (23) and then injected toward the lower portion of the LNG storage tank (1) which has a lower temperature, thereby maintaining a uniform temperature distribution of the LNG storage tank (1) and ultimately reducing generation of boil-off gas.

Such reduction of generation of boil-off gas is particularly useful for gradually increasing the pressure in the LNG storage tank because the generation of boil-off gas in an LNG carrier without having boil-off gas treating means has direct connection with the increase in pressure in the LNG storage tank. In case of an LNG carrier having boil-off gas treating means, if the pressure in the LNG storage tank is increased, a certain amount of boil-off gas is discharged to the outside, thereby controlling the pressure in the LNG storage tank, and consequently, spray of LNG or injection of boil-off gas may not be needed during the voyage of the LNG carrier.

In addition, if LNG is loaded in a sub-cooled liquid state into an LNG carrier at a production terminal where LNG is produced, it is possible to further reduce the generation of boil-off gas (or the increase in pressure) during the transportation of LNG to a destination. The pressure in the LNG storage tank for an LNG carrier can be a negative pressure (0 bar or lower) after LNG is loaded in a sub-cooled liquid state at a production terminal. To prevent the pressure from being decreased to a negative pressure, a vapor region of the LNG storage tank may be filled with nitrogen.

A method for treating boil-off gas using such an LNG storage tank for an LNG carrier will be described below.

During the voyage of an LNG carrier, the LNG storage tank (1) for an LNG carrier according to the present invention allows a pressure increase in the LNG storage tank (1) without treating the boil-off gas generated in the LNG storage tank (1), thereby increasing the temperature in the LNG storage tank (1), and accumulating most of the heat influx as internal energy of LNG and NG in the LNG storage tank, and then treating the boil-off gas accumulated in the LNG storage tank (1) for an LNG carrier at an unloading terminal when the LNG carrier arrives at a destination.

Figure 5:
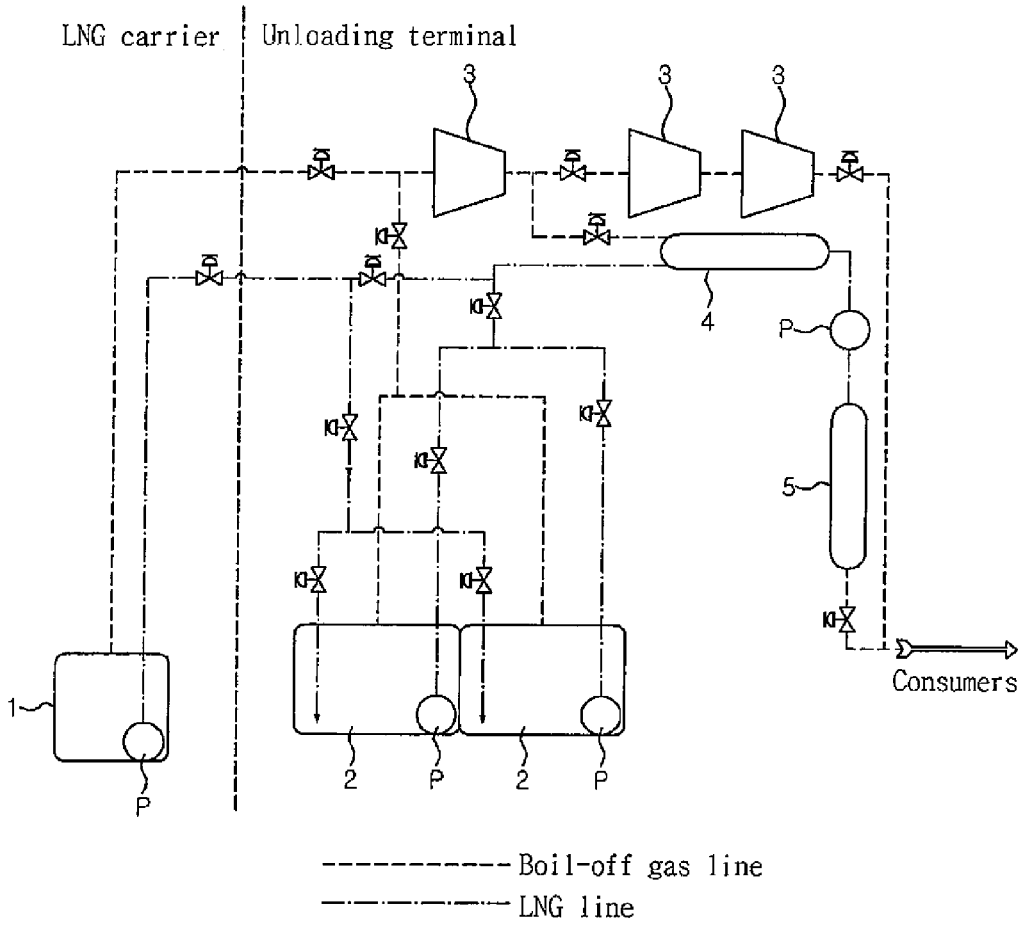
FIG. 5 is a schematic diagram illustrating a configuration for treating boil-off gas (BOG) at an unloading terminal by using an LNG storage tank for an LNG carrier according to the preferred embodiment of the present invention.

FIG. 5 schematically illustrates a configuration for treating boil-off gas at an unloading terminal using the LNG storage tank for an LNG carrier according to the preferred embodiment of the present invention.

The unloading terminal is installed with a plurality of LNG storage tanks (2) for an unloading terminal, a high-pressure compressor (3*a*), a low-pressure compressor (3*b*), a recondenser (4), a high-pressure pump (P), and a vaporizer (5).

As a large amount of boil-off gas is accumulated in the LNG storage tank (1) for an LNG carrier, the boil-off gas in the LNG storage tank (1) is generally compressed to 70-80 bar by the high-pressure compressor (3*a*) at unloading terminals and then supplied directly to consumers. Part of the boil-off gas accumulated in the LNG storage tank (1) for an LNG carrier may generally be compressed to approximately 8 bar by the low-pressure compressor (3*b*), then recondensed by passing through the recondenser (4), and then regasified by the vaporizer (5) so as to be supplied to consumers.

When LNG is unloaded from the LNG storage tank for an LNG carrier to be loaded into an LNG storage tanks for an unloading terminal, additional boil-off gas is generated due to inflow of LNG having a higher pressure into the LNG storage tanks for an unloading terminal because the pressure of the LNG storage tank for an LNG carrier is higher than that of the LNG storage tank for an unloading terminal. To minimize generation of additional boil-off gas, LNG can be supplied to consumers by transmitting the LNG from the LNG storage tank for an LNG carrier directly to an inlet of a high-pressure pump at an unloading terminal. The LNG storage tank for an LNG carrier according to the present invention, as the pressure in the LNG storage tank is high during the unloading of LNG, has an advantage of shortening an unloading time by 10 to 20% over conventional LNG storage tanks.

Instead of being supplied to the LNG storage tanks (2) for an unloading terminal at an unloading terminal, the LNG stored in the LNG storage tank (1) for an LNG carrier may be supplied to the recondenser (4) to recondense boil-off gas and then regasified by the vaporizer (5), thereby being supplied directly to consumers.

On the other hand, if a recondenser is not installed at an unloading terminal, LNG may be supplied directly to a suction port of the high-pressure pump (P).

As stated above, if the plurality of LNG storage tanks (2) for an unloading terminal are installed at an unloading terminal and LNG is evenly distributed from the LNG storage tank (1) for an LNG carrier to each of the plurality of LNG storage tanks (2) for an unloading terminal, the effect of generation of boil-off gas in the LNG storage tanks (2) for an unloading terminal can be minimized due to dispersion of the generation of boil-off gas to the plurality of the LNG storage tanks (2) for an unloading terminal. Since the amount of boil-off gas generated in the LNG storage tanks (2) for an unloading terminal is small, the boil-off gas is generally compressed by the low-pressure compressor (3*b*) to approximately 8 bar and then recondensed by passing through the recondenser (4), and then regasified by the vaporizer (5), to be supplied to consumers.

In addition, according to the present invention, as the LNG storage tank for an LNG carrier is operated at a higher pressure than an existing design pressure, a process of filling boil-off gas or NG vapor in the LNG storage tank for an LNG carrier is not required to maintain the pressure in the LNG storage tank for an LNG carrier during the unloading of LNG.

Further, if a conventional LNG storage tank for an LNG terminal or for a floating storage and regasification unit (FSRU) is modified, or a new LNG storage tank for an unloading terminal or for a floating storage and regasification unit (FSRU) is constructed such that the storage pressure of the LNG storage tank corresponds to the pressure of the LNG storage tank for an LNG carrier according to the present invention, no additional boil-off gas is generated during the unloading of LNG from the LNG carrier, and consequently an existing unloading technique can be applied.

According to the present invention, an LNG regasification vessel (LNG-RV) may have merits of both an LNG carrier and an LNG floating storage and regasification unit (FSRU) as stated above.

Figure 6:
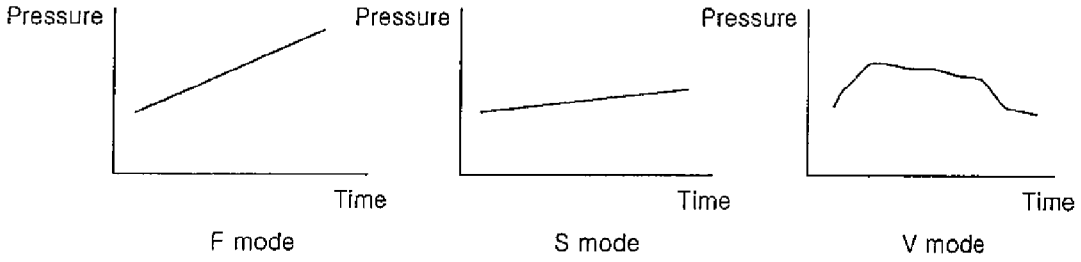
FIG. 6 is a diagram illustrating the pressure operation types of an LNG storage tank for an LNG carrier, during the loaded voyage of the LNG carrier, according to the pressure of an LNG storage tank at an LNG unloading terminal.

FIG. 6 illustrates pressure operation types of an LNG storage tank for an LNG carrier during the voyage of the LNG carrier having LNG loaded therein, according to the pressure in the LNG storage tank at an LNG unloading terminal. F mode indicates the voyage of an LNG carrier, in which, for example, if the allowable pressure of the LNG storage tank at the unloading terminal ranges from 0.7 bar to 1.5 bar or lower, the pressure in the LNG storage tank for the LNG carrier is allowed to be continually increased to 0.7 to 1.5 bar or lower, the same as the allowable pressure of the LNG storage tank at an LNG unloading terminal. This mode is particularly useful in an LNG carrier without boil-off gas treating means.

S or V mode is appropriate when the allowable pressure of an LNG storage tank at an unloading terminal is 0.4 bar or lower. S and V modes are applicable to an LNG carrier having boil-off gas treating means. S mode indicates the voyage of an LNG carrier in which the pressure in the LNG storage tank of the LNG carrier is allowed to be continually increased to 0.4 bar or lower, the same as the allowable pressure of the LNG storage tank of an LNG unloading terminal.

V mode is to enlarge the width of operation of the pressure in the LNG storage tank for an LNG carrier, and has an advantage of reducing waste of boil-off gas by storing the excessive boil-off gas exceeding the amount of boil-off gas consumed by boil-off gas treating means, in the LNG storage for an LNG carrier. For example, when an LNG carrier passes through a canal, boil-off gas is not consumed because propulsion means using the boil-off gas as a fuel, such as a DFDE, MEGI, and gas turbine, does not operate. Accordingly, the boil-off gas generated in the LNG storage tank for an LNG carrier can be stored therein, thereby being capable of increasing the pressure of the LNG storage tank for an LNG carrier to 0.7 to 1.5 bar or lower. After an LNG carrier passes through a canal, the propulsion means using boil-off gas as a fuel is fully operated, thereby being capable of increasing the consumption of boil-off gas and decreasing the pressure of the LNG storage tank for an LNG carrier to 0.4 bar or lower.

The pressure operation types of an LNG storage tank for an LNG carrier can vary depending on whether or not a flash gas treatment facility for treating a large amount of flash gas is installed at an LNG unloading terminal. In case a flash gas treatment facility for treating a large amount of flash gas is installed at an LNG unloading terminal, the pressure of the LNG storage tank for an LNG carrier is operated in an F mode; in case a flash gas treatment facility for treating a large amount of flash gas is not installed at an LNG unloading terminal, the pressure of the LNG storage tank for an LNG carrier is operated in an S or V mode.

Figure 7:
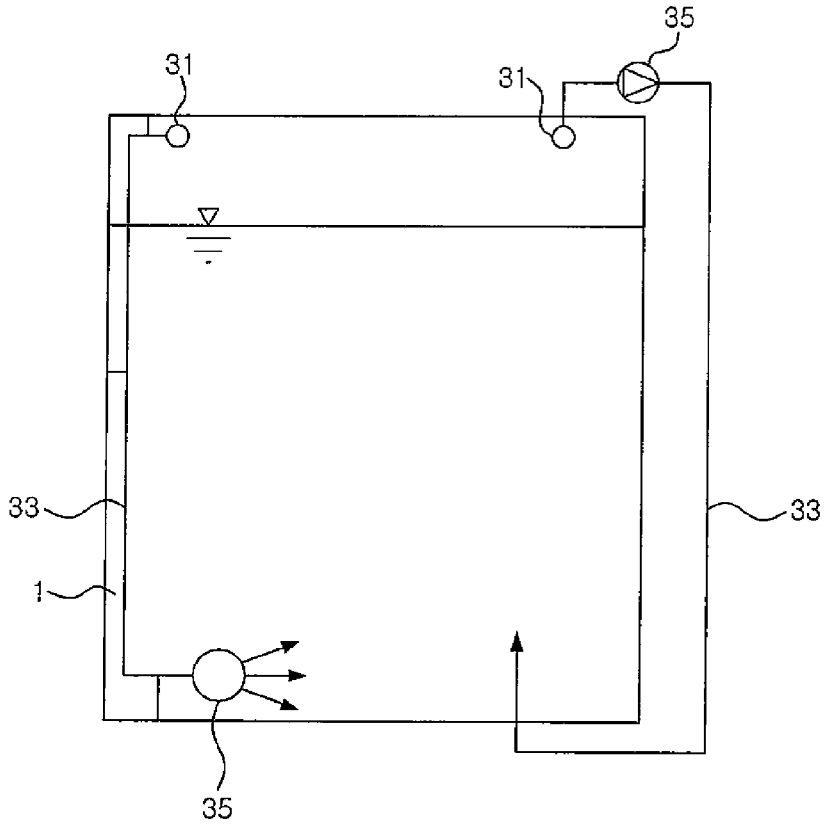
FIG. 7 is a diagram illustrating a method for injection of boil-off gas from an upper portion of an LNG storage tank toward LNG at a lower portion of the LNG storage tank.

FIG. 7 illustrates an apparatus for reducing the pressure increase in an LNG storage tank for an LNG carrier by injection of the boil-off gas at an upper portion of the LNG storage tank toward the LNG at a lower portion thereof.

The apparatus for reducing the pressure increase in the LNG storage tank for an LNG carrier as illustrated in FIG. 7 is configured to compress the boil-off gas at an upper portion of the LNG storage tank (1) for an LNG carrier and then to inject the compressed boil-off gas toward the LNG at an lower portion of the LNG storage tank (1).

This apparatus comprises a boil-off gas suction port (31) provided at an upper portion of the LNG storage tank for an LNG carrier, a pipe (33) having one end connected to the boil-off gas suction port (31) and the other end connected to the lower portion of the LNG storage tank (1), and a compressor (35) provided at a portion of the pipe (33).

As illustrated in the left side of FIG. 7, the pipe (33) can be installed in the LNG storage tank (1). If the pipe (33) is installed in the LNG storage tank (1), it is desirable that the compressor (35) should be a submerged type compressor provided at a lower portion of the pipe (33).

As illustrated in the right side of FIG. 7, the pipe (33) can be installed outside the LNG storage tank (1). If the pipe (33) is installed outside the LNG storage tank (1), the compressor (35) is an ordinary compressor provided at the pipe (33). The ordinary compressor means a compressor which is not of a sealed type.

It is desirable that liquid suction prevention means should be provided at the boil-off gas suction port (31). One example of the liquid suction prevention means is a demister.

The apparatus for reducing the pressure increase in the LNG storage for an LNG carrier is configured to reduce the local increase in the temperature and pressure of the LNG storage tank, thereby reducing the pressure of the LNG storage tank. The generation of boil-off gas can be reduced by injecting the boil-off gas, having a higher temperature, at an upper portion of the LNG storage tank (1) for an LNG carrier toward a lower portion of the LNG storage tank (1) for an LNG carrier having a lower temperature, thereby maintaining a uniform temperature distribution of the LNG storage tank for an LNG carrier, that is, preventing the local increase in the temperature in the LNG storage tank.

Figure 8:
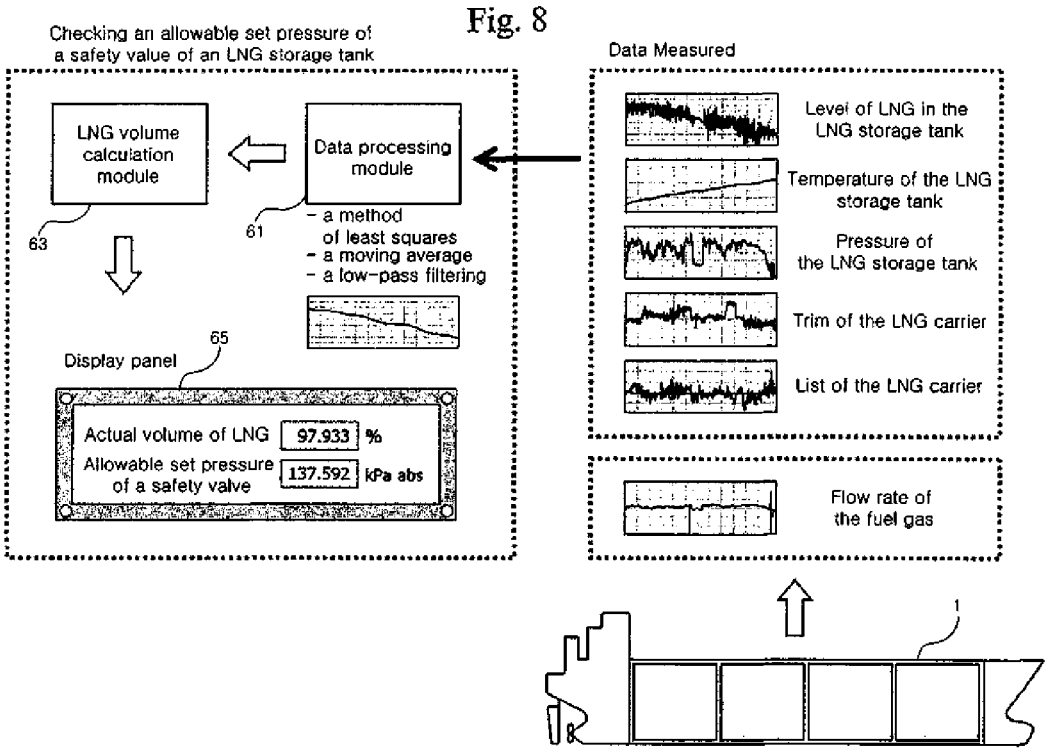
FIG. 8 is a diagram illustrating a system for displaying in real time a current allowable maximum set pressure of a safety valve of an LNG storage tank for an LNG carrier by receiving related data in real time and appropriately processing and calculating the data during the voyage.

FIG. 8 illustrates a diagram of a system for displaying in real time a currently allowable maximum set pressure of an LNG storage tank for an LNG carrier by receiving related data in real time during the voyage of the LNG carrier, and appropriately processing and calculating the data. A safety valve of the LNG storage tank can be safely controlled by the system.

In case of an LNG carrier provided with a safety relief valve (SRV) or safety valve of the LNG storage tank, the set pressure of the safety valve is initially set low so as to maximize the cargo loading, but can be increased during the voyage according to the LNG volume decrease due to the consumption of boil-off gas.

If the set pressure of the safety valve is increased during the voyage, the amount of boil-off gas generated from the LNG storage tank (1) is decreased, thereby being capable of minimizing the amount of boil-off gas discharged to the atmosphere or consumed in a combustion unit.

As the measured values such as the level of LNG in the LNG storage tank are frequently changed during the voyage, the present invention comprises a system for eliminating outside noise and fluctuation caused by dynamic movement of a ship through an appropriate data processing, a system for calculating an allowable set pressure of the safety valve of the LNG storage tank by calculating the actual volume of the LNG in the LNG storage tank (1) by using the processed data, and an apparatus for displaying the results.

FIG. 8 illustrates in the right side the related data measured to calculate the volume of the LNG in the LNG storage tank (1). The level of the LNG in the LNG storage tank was measured by an existing level gauge (not illustrated), the temperature of the LNG storage tank was measured by an existing temperature sensor (not illustrated), the pressure of the LNG storage tank was measured by an existing pressure sensor (not illustrated), the trim of the LNG carrier was measured by an existing trim sensor (not illustrated), and the list of the LNG carrier was measured by an existing list sensor (not illustrated). The trim of the LNG carrier indicates a front-to-back gradient of the LNG carrier, and the list of the LNG carrier indicates a left-to-right gradient of the LNG carrier.

The system for confirming a set pressure of the safety valve of the LNG storage tank according to the embodiment, as illustrated in the left side of FIG. 8, comprises a data processing module (61) for processing the measured data as illustrated in the right side of FIG. 8.

It is desirable to process the data in the data processing module (61) by using a method of least squares, a moving average, or a low-pass filtering.

In addition, the system for confirming the set pressure of the safety valve of the LNG storage tank further comprises an LNG volume calculating module (63) for calculating the volume of the LNG in the LNG storage tank (1) by calculating the data processed in the data processing module (61).

The system for confirming the set pressure of the safety valve of the LNG storage tank calculates an allowable set pressure of the safety valve of the LNG storage tank (1) from the volume of the LNG calculated by the LNG volume calculating module (63).

On the other hand, it is possible to calculate the current volume of the LNG in the LNG storage tank by measuring the flow rate of the fuel gas supplied from the LNG storage tank (1) to fuel gas propulsion means of an LNG carrier and comparing the initial load of LNG with the amount of the used boil-off gas to, and to reflect the volume of the LNG calculated from the flow rate of the fuel gas measured as described above in the volume of the LNG calculated by the LNG volume processing module (63).

The allowable set pressure of the safety valve of the LNG storage tank and the volume of the LNG in the LNG storage tank calculated as described above are displayed on a display panel (65).

Figure 9:
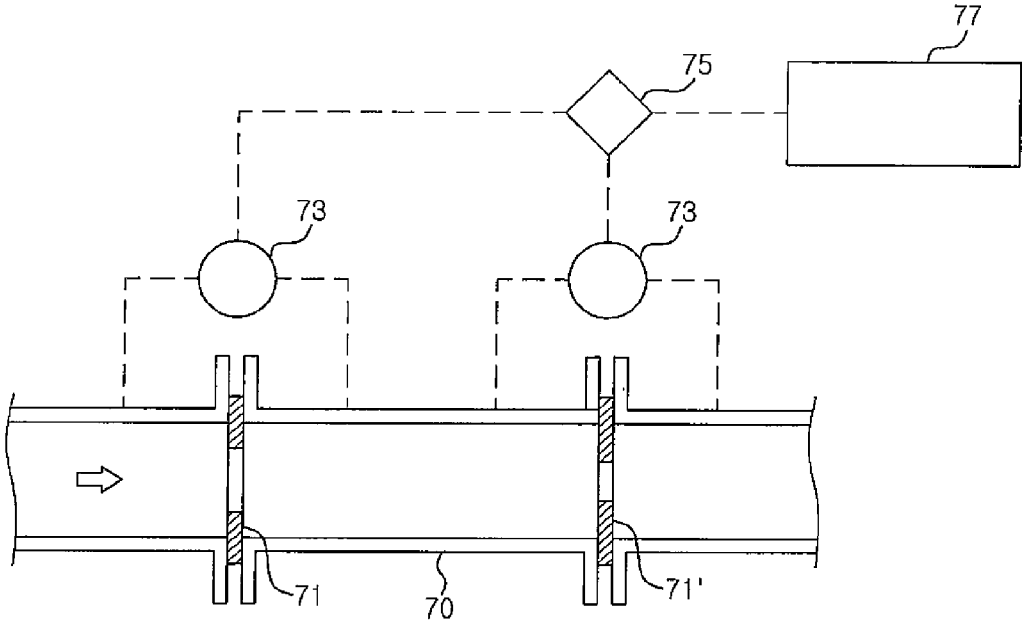
FIG. 9 illustrates a fuel gas flow meter of an LNG carrier according to the present invention.

FIG. 9 illustrates a fuel gas flow meter for measuring the flow rate of the fuel gas of an LNG carrier according to the present invention.

A differential pressure flow meter is used for measuring the flow rate of the fuel gas of an LNG carrier. In the flow meter, the measurement range is limited, and a large measurement error can occur for the flow rate out of the measurement range. To change the measurement range, an orifice itself should be replaced, which is an annoying and dangerous job.

Conventionally, only one orifice is installed and consequently the measurement range is limited, but if two orifices having different measurement ranges are arranged in series, the effective measurement range can be expanded simply by selecting and using the proper measurement values of the orifices according to the flow rate.

That is to say, to measure a large range of the flow rate of fuel gas, the effective measurement range can be simply expanded by arranging at least two orifices in series, each orifice having a different measurement range, and selecting and using the appropriate measurement values of the orifices according to the flow rate. In FIG. 9, orifices (71, 71'), each having a different measurement range, are arranged in series in the middle of a fuel supply line pipe (70) for supplying a fuel gas from the LNG storage tank for an LNG carrier to fuel gas propulsion means. Differential pressure measurers (73) are connected to the fuel supply line pipe (70) of front and back portions of each of the orifices (71, 71'). These differential pressure measurers (73) are selectively connected to the flow meter (77) through a selector (75) which is selectable according to the measurement range.

The effective measurement range can be simply expanded by installing the selector (75), which is selectable according to the measurement range as described above, between the differential pressure measurers (73) and the flow meter (77) and selecting and using the appropriate measurement values of the orifices according to the flow rate.

In a conventional system, the capacity of a fuel gas orifice is set near NBOG (natural boil-off gas). Accordingly, in case of an LNG carrier whose consumption of boil-off gas is small, the accuracy in measurements is low. To make up for this inaccuracy, the present invention provides a method of additionally installing small orifices in series.

This method can measure the level, or volume, of the LNG in the LNG storage tank from the amount of LNG consumed.

In addition, the prior art does not know the composition of boil-off gas, which is an additional factor of reducing the accuracy in measurements. To make up for this, the composition of boil-off gas may be considered by adding gas chromatography.

Further, if the measurement of the level of LNG in the LNG storage becomes accurate as described above, it can improve the efficiency of the boil-off gas management method and apparatus of the present invention which maintains the pressure of the LNG storage tank at a somewhat higher than the prior art. That is, accurate measurement of the volume of LNG in an LNG storage tank can facilitate changing the setting of a safety valve of the LNG storage tank into multiple settings, and reduce the consumption of boil-off gas.

Figure 10:
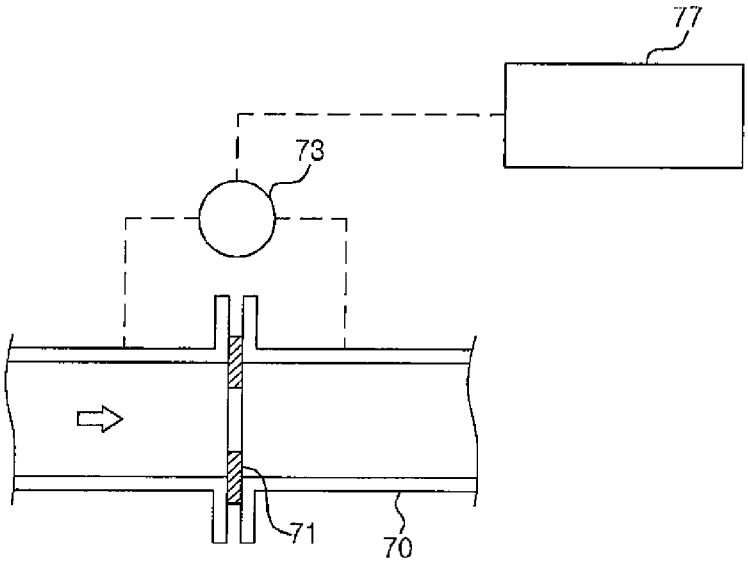
FIG. 10 illustrates a fuel gas flow meter of a conventional LNG carrier.

FIG. 10 illustrates a fuel gas flow meter for a conventional LNG carrier. Conventionally, a conventional fuel gas flow meter comprises only one orifice (71) for differential pressure type flow rate measuring of fuel gas, and consequently has a disadvantage of obtaining an effective measurement value within a specific measurement range.

Figure 11:
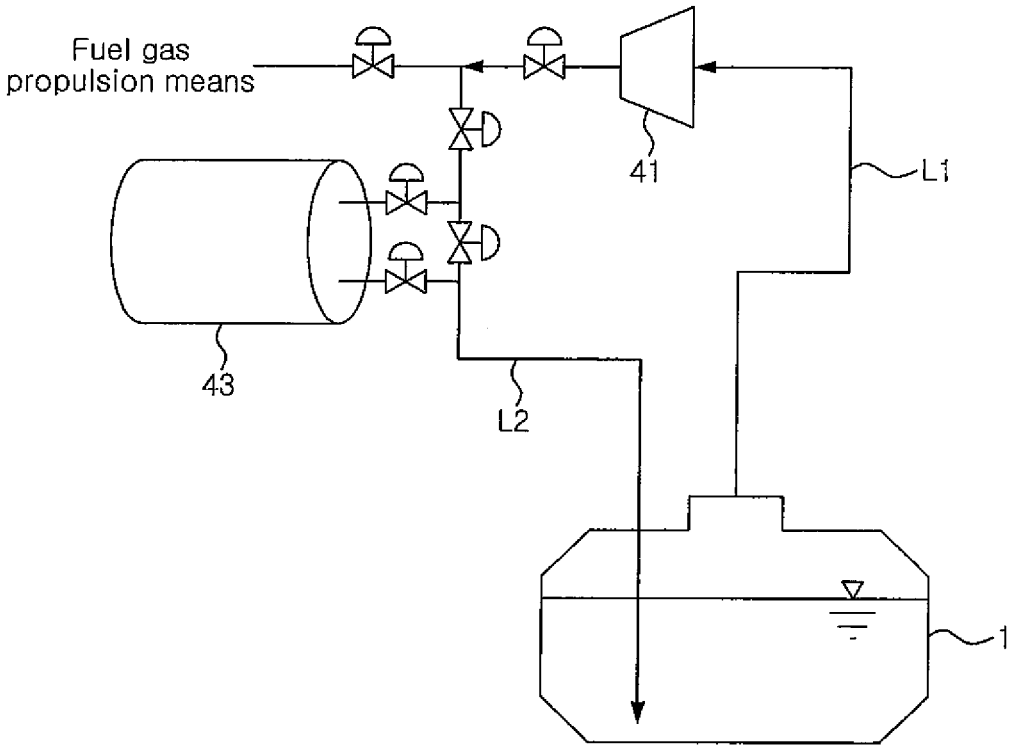
FIG. 11 illustrates supply of boil-off gas, after being compressed, to a lower portion of an LNG storage tank according to an embodiment of the present invention.

FIG. 11 illustrates supply of boil-off gas to a lower portion of an LNG storage tank after compressing the boil-off gas according to an embodiment of the present invention.

An LNG carrier, which has fuel gas propulsion means using as a propulsion fuel the compressed boil-off gas by compressing the boil-off gas at an upper portion of the LNG storage tank for an LNG carrier, cannot use the fuel gas at all when passing through a canal such as the Suez Canal, and consequently there is a great possibility of local increase in the temperature and pressure of the LNG storage tank. A boil-off gas extracting apparatus may be additionally needed to solve this problem. That is, as illustrated in FIG. 11, a small amount of boil-off gas is extracted and compressed by a boil-off compressor (approximately 3 to 5 bar), and then put into a lower portion of the LNG storage tank (1).

To do this, a boil-off gas branch line (L2) for returning the boil-off gas to the LNG storage tank (1) is installed in the middle of a fuel gas supply line (L1) for supplying compressed boil-off gas to the fuel gas propulsion means after compressing the boil-off gas at an upper portion of the LNG storage tank (1) for an LNG carrier. In addition, a compressor (41) is installed in the middle of the fuel gas supply line (L1) upstream of a meeting point of the fuel gas supply line (L1) and the boil-off gas branch line (L2).

A buffer tank (43) is installed in the middle of the boil-off gas branch line (L2). As there is a big difference between the pressure of the boil-off gas passing through the compressor (41) and the pressure of the LNG storage tank (1), it is desirable to temporarily store the boil-off gas passing through the compressor (41) in the buffer tank (43) and control the pressure of the boil-off gas to match the pressure of the LNG storage tank (1) and then return the boil-off gas to the LNG storage tank (1).

It is desirable to operate an apparatus for reducing pressure increase in the LNG storage tank for an LNG carrier at an interval of about 10 minutes per 2 hours.

Some examples of the fuel gas propulsion means are a double fuel diesel electric propulsion system (DFDE), a gas injection engine, and a gas turbine.

An LNG carrier, to which a DFDE, a gas injection engine, or a gas turbine is applied, uses the concept of compressing boil-off gas by a boil-off gas compressor and then sending the compressed boil-off gas to an engine to burn the boil-off gas. However, an LNG carrier which is configured to eliminate or reduce the discharge of boil-off gas of an LNG storage tank, as in the present invention, if no or a small amount of fuel gas is consumed in fuel gas propulsion means, to prevent a severe pressure increase due to a local increase in temperature in an LNG storage tank, compresses boil-off gas and then return the compressed boil-off gas to a lower portion of the LNG storage tank through a boil-off gas branch line, instead of sending the compressed boil-off gas to a DFDE.

Another embodiment of the present invention provides a fuel gas supply system for gasifying the LNG of an LNG storage tank and supplying the gasified LNG as a fuel gas to fuel gas propulsion means. That is, in the prior art, the fuel gas propulsion means uses as a fuel, not only LNG but also boil-off gas by using a high-pressure compressor, but the present invention does not use boil-off gas at all.

Instead, a boil-off gas reliquefaction apparatus using cold energy of LNG can be added. That is, boil-off gas is compressed and exchanges heat with the LNG of the fuel gas supply line, thereby being cooled (by the recondenser; there is no N2 refrigerator). In this case, only 40-60% of NBOG is reliquefied, but there is no problem because the LNG carrier according to the present invention is configured to eliminate or reduce the discharge of boil-off gas from the LNG storage tank. Further, if necessary, a small boil-off gas reliquefaction plant having a capacity of approximately 1 ton/hour can be installed particularly for ballast voyage.

The LNG storage tank (1) for an LNG carrier used in the fuel gas supply system according to this embodiment is designed to have strength to withstand pressure increase due to boil-off gas so as to allow pressure increase due to boil-off gas generated in the LNG storage tank during the voyage of the LNG carrier.

Figure 12:
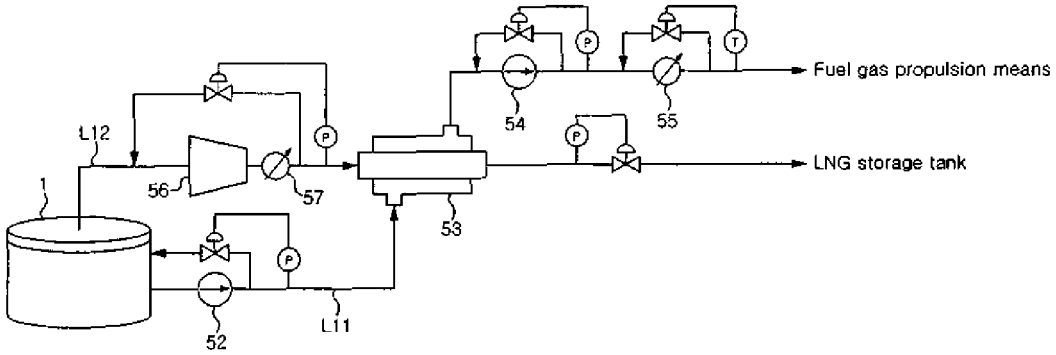
FIG. 12 is a schematic diagram illustrating a fuel gas supply system of an LNG carrier according to an embodiment of the present invention.

The fuel gas supply system in FIG. 12 comprises a fuel gas supply line (L11) for extracting LNG from the LNG storage tank for an LNG carrier and supplying the extracted LNG to the fuel gas propulsion means, and a heat exchanger (53) provided in the middle of the fuel gas supply line (L11), the heat exchanger (53) exchanging heat between the LNG and the boil-off gas extracted from the LNG storage tank (1).

A first pump (52) is installed in the fuel gas supply line (L11) upstream of the heat exchanger (53), so as to supply LNG, which has been compressed to meet the flow rate and pressure demands of the fuel gas propulsion means, to the fuel gas propulsion means.

A boil-off gas liquefaction line (L12) passes through the heat exchanger (53) so as to extract boil-off gas from the upper portion of the LNG storage tank (1) and return the extracted boil-off gas to one side of the LNG storage tank (1).

LNG whose temperature is increased by exchanging heat with the boil-off gas in the heat exchanger (53) is supplied to the fuel gas propulsion means, and boil-off gas which has been liquefied by exchanging heat with the LNG is returned to the LNG storage tank (1).

A second pump (54) is installed in the fuel gas supply line (L11) downstream of the heat exchanger (53) so as to supply to the fuel gas propulsion means the LNG which has exchanged heat with the boil-off gas in the heat exchanger (53) and has been compressed to meet the flow rate and pressure demands of the fuel gas propulsion means.

A heater (55) is installed in the fuel gas supply line (L11) downstream of the second pump (54) so as to heat the LNG which has exchanged heat with the boil-off gas in the heat exchanger (53) to supply the LNG to the fuel gas propulsion means.

A boil-off gas compressor (56) and a cooler (57) are sequentially installed in the boil-off gas liquefaction line (L12) upstream of the heat exchanger (53) so as to compress and cool the boil-off gas extracted from the LNG storage tank and then exchange heat between the boil-off gas and LNG.

In case the fuel gas pressure demand of the fuel gas propulsion means is high (e.g. 250 bar), LNG is compressed to 27 bar by the first pump (52), the temperature of the LNG, while passing through the heat exchanger (53), is increased from approximately −163° C. to approximately −100° C., and the LNG in a liquid state is supplied to the second pump (54) and compressed to approximately 250 bar by the second pump (54) (as it is in a supercritical state, there is no division between liquid and gas states), then gasified, while being heated in the heater (55), and then supplied to the fuel gas propulsion means. In this case, though the temperature of LNG, while passing through the heat exchanger (53), is increased, LNG is not gasified because the pressure of LNG supplied to the heat exchanger is high.

On the other hand, in case the fuel gas pressure demand of the fuel gas propulsion means is low (e.g. 6 bar), LNG is compressed to 6 bar by the first pump (52), part of the LNG is gasified while passing through the heat exchanger (53), supplied to the heater (55) and heated in the heater (55), and then supplied to the fuel gas propulsion means. In this case, the second pump (54) is not necessary.

According to this fuel gas supply system of an LNG carrier, LNG is extracted from the LNG storage tank, the extracted LNG is compressed to meet the flow rate and pressure demands of the fuel gas propulsion means, and the compressed LNG is supplied to the fuel gas propulsion means, but the supply of LNG to the fuel gas propulsion means is done after heat exchange between the LNG and boil-off gas extracted from the LNG storage tank. Accordingly, the fuel gas supply system has advantages of simplifying the configuration, reducing the required power, and preventing a severe increase in pressure of the LNG storage tank due to accumulation of boil-off gas therein, in supplying a fuel gas from an LNG carrier to the fuel gas propulsion means.

Figure 13:
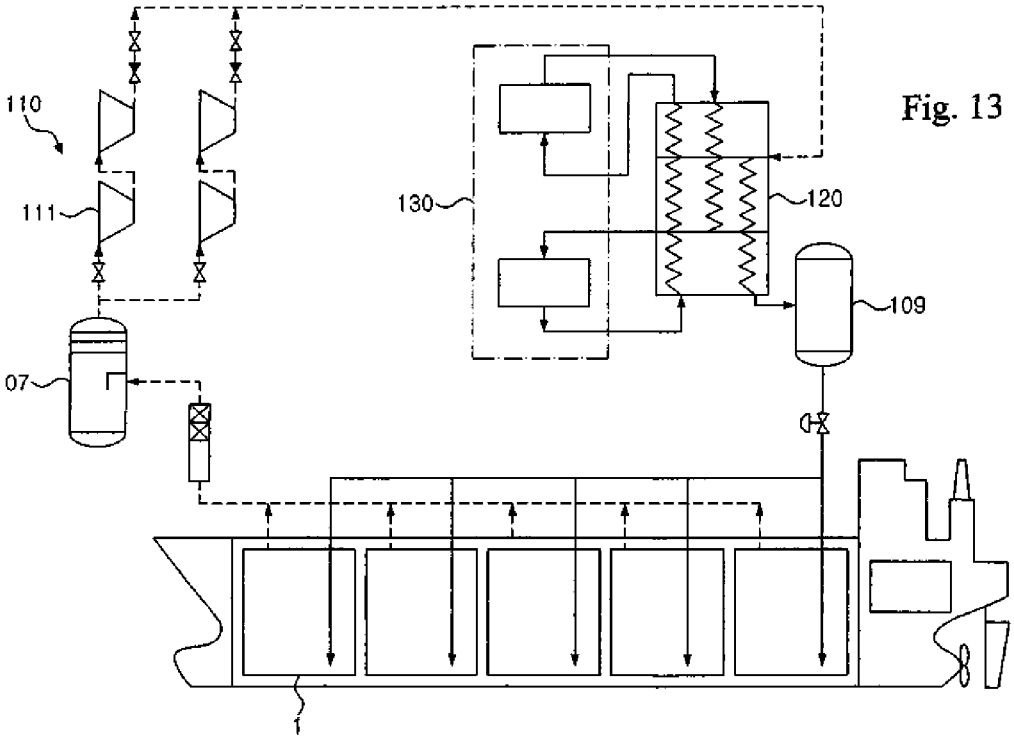
FIG. 13 is a conceptual diagram for explaining a method for treating boil-off gas in an LNG carrier having a reliquefaction plant according to the present invention.

According to the preferred embodiment of the present invention, a method for treating boil-off gas in an LNG carrier having a reliquefaction plant will be described in detail below with references to FIGS. 13 and 14. FIG. 13 shows a conceptual diagram for explaining a method for treating boil-off gas in an LNG carrier having a reliquefaction plant according to the preferred embodiment of the present invention.

As illustrated in FIG. 13, the LNG carrier comprises an LNG storage tank (1) for storing LNG therein, and a reliquefaction plant for reliquefying boil-off gas generated in the LNG storage tank (1) and then returning the boil-off gas to the LNG storage tank.

The reliquefaction plant comprises: a boil-off gas compression unit (110) for compressing the boil-off gas generated in the LNG storage tank (1); a condenser (120) for condensing the compressed boil-off gas by exchanging heat with a refrigerant; and a refrigerant system (130) for providing cold heat for condensing the boil-off gas in the condenser.

The boil-off gas compression unit (110) can include at least one boil-off gas compressor (111), and it may be good to install a precooler (107) upstream of the boil-off gas compression unit (110) and precool the boil-off gas discharged from the LNG storage tank (1) so as to stably reliquefy the boil-off gas.

It is desirable to provide a gas-liquid separator (109; or a buffer tank) downstream of the condenser (120) to temporarily store the reliquefied LNG so as to stably return to the LNG storage tank (1) the boil-off gas, or LNG, which has been compressed while passing through the condenser (120).

The refrigerant system (130) is to supply cold heat for liquefying the boil-off gas through the condenser (120), and uses as a working fluid a refrigerant having predetermined temperature and flow rate. This refrigerant system (130) comprises a refrigerant compressor, a heat exchanger, and an expansion means, as a kind of refrigeration cycle.

Conventionally, in case an amount of boil-off gas greater than a treatment capacity of a reliquefaction is generated, as illustrated in FIG. 1, a conventional LNG carrier is provided with a gas combustion unit (103), and surplus boil-off gas is heated in a gas heater (105) up to an appropriate temperature for combustion and supplied to the gas combustion unit (103), and then burned and wasted.

However, the present invention, maintaining a pressure in the LNG storage tank (1) somewhat higher (approximately 108-109 kPa) than the prior art (approximately 106 kPa), reliquefies an amount of boil-off gas corresponding to 100 percent of treatment capacity of the reliquefaction plant and then returns the boil-off gas to the LNG storage tank (1), and leaves surplus boil-off gas beyond the treatment capacity of the reliquefaction plant in the LNG storage tank, instead of discharging it to the outside.

To carry out the boil-off gas treating method according to the present invention, the boil-off gas treating apparatus having an LNG carrier therein according to the present invention comprises a controller (not illustrated) for controlling a BOG discharging means such as a discharge valve (not illustrated) provided in each LNG storage tank (1) so that an amount of boil-off gas exactly corresponding to 100 percent of treatment capacity of the reliquefaction plant can be discharged to the outside of the LNG storage tank (10), while maintaining an internal pressure of the LNG storage tank (1) somewhat higher (approximately 108-109 kPs) than the prior art (approximately 106 kPa) by allowing the internal pressure of the LNG storage tank (1) to be increased compared to the beginning of the loaded voyage.

Figure 14:
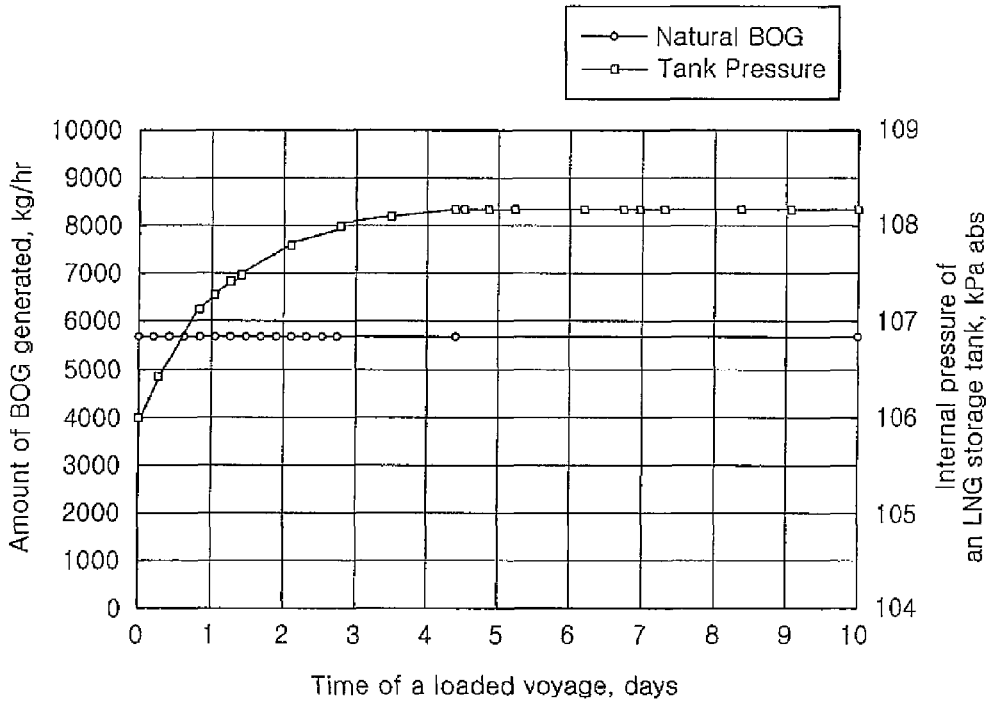
FIG. 14 is a graph showing changes over time in an internal pressure of an LNG storage tank and in an amount of boil-off gas generated in the LNG storage tank according to the boil-off gas treating method shown in FIG. 13.

FIG. 14 shows a graph showing changes over time in the internal pressure of the LNG storage tank and in the amount of boil-off gas generated in the LNG storage tank according to the boil-off gas treating method according to the present invention as illustrated in FIG. 13.

As shown in FIG. 14, in case of maintaining a constant amount of boil-off gas discharged from the LNG storage tank (1) approximately 5,643 kg/hr, a large amount of boil-off gas is generated in the LNG storage tank (1) for 3 to 4 days at the beginning of the loaded voyage, and consequently the internal pressure of the LNG storage tank which is approximately 106 kPa at the beginning of the voyage is increased to approximately 108.2 kPa. The internal pressure of the LNG storage tank (1) becomes stable at a level of approximately 108.2 kPa after 3 to 4 days from the beginning of the voyage.

As stated above, since the present invention limits the amount of boil-off gas discharged from the LNG storage tank (1) to fit the treatment capacity of the reliquefaction plant, and leaves the surplus boil-off gas beyond the treatment capacity of the reliquefaction plant in the LNG storage tank (1), instead of discharging it to the outside, all boil-off gas discharged is reliquefied and returned to the LNG storage tank (1).

Accordingly, the present invention can prevent waste of boil-off gas, compared to the prior art which burns and wastes all surplus boil-off gas beyond the treatment capacity of a reliquefaction plant, and does not need additional equipment such as a combustor, and can save energy.

In addition, the embodiments illustrated in FIGS. 13 and 14 show that the internal pressure of the LNG storage tank (1) is maintained at approximately 108-109 kPa. However, the present invention can withstand higher pressure by reinforcing the LNG storage tank (1), and can be transformed to save energy which is otherwise wasted in the reliquefaction plant by maintaining the internal pressure of the LNG storage tank (1) at a higher level and reducing the amount of boil-off gas reliquefied through the reliquefaction plant.

Through the method and the apparatus for treating boil-off gas in an LNG carrier having a reliquefaction plant according to the present invention has been shown and described herein with references to the drawings, it would be understood that various modifications and variations may occur to those skilled in the art, and thus the description and drawings herein should be interpreted by way of illustrative purpose without limiting the scope and spirit of the present invention.

As stated above, the present invention provides a boil-off gas treating method and apparatus which can prevent waste of boil-off gas and save energy by storing in an LNG storage tank, instead of discharging and burning, the surplus boil-off gas which has not been returned to the LNG storage tank through a reliquefaction plant among the total amount of boil-off gas generated in the LNG storage tank.

What is claimed:

1. A method for treating boil-off gas generated in an LNG storage tank of an LNG carrier for transporting LNG in a cryogenic liquid state, comprising the steps of discharging boil-off gas from the LNG storage tank at a pressure greater than 0.25 bar to 2 bar, and reliquefying said boil-off gas in a reliquefaction plant, wherein a uniform temperature distribution is maintained in the LNG storage tank by spraying the LNG from a lower portion of the LNG storage tank toward boil-off gas at an upper portion of the LNG storage tank and injecting the boil off gas into the LNG at the lower portion of the LNG storage tank, and wherein the amount of boil-off gas that is discharged is regulated as a function of the level of LNG in the LNG storage tank, wherein the level of LNG in the LNG storage tank is calculated by measuring the flow rate of fuel gas supplied from the LNG storage tank to a fuel gas supply line to a fuel gas propulsion means, and wherein the flow rate of fuel gas is measured by a flow rate measurer within the fuel gas supply line.

2. The method according to claim 1, further comprising the step of retaining in the LNG storage tank an amount of surplus boil-off gas that is in excess of the treatment capacity of the boil-off gas treating means of the LNG carrier.

3. The method according to claim 2, further comprising the steps of:

retaining the surplus boil-off gas at the beginning of the loaded voyage of the LNG carrier; and discharging boil-off gas during the voyage to maintain a constant pressure in the LNG storage tank.

4. The method according to claim 3, wherein the treatment capacity of the reliquefaction plant corresponds to the amount of boil-off gas generated in the LNG storage tank when the pressure in the LNG storage tank is maintained at a constant level.

5. The method according to claim 1, further comprising the steps of:

compressing the boil-off gas discharged from the LNG storage tank in a boil-off gas compression unit;

condensing the compressed boil-off gas in a condenser by exchanging heat with a refrigerant; and returning the condensed boil-off gas to the LNG storage tank.

6. The method according to claim 5, further comprising the step of precooling the boil-off gas discharged from the LNG storage tank in a precooler so as to stably reliquefy the boil-off gas, before the step of compressing the boil-off gas.

7. The method according to claim 5, further comprising the step of temporarily storing the condensed boil-off gas in a gas-liquid separator so as to stably return to the LNG storage tank the boil-off gas which has been condensed while passing through the condenser, after the step of condensing the boil-off gas.

8. A method for treating boil-off gas generated in an LNG storage tank of an LNG carrier for transporting LNG in a cryogenic liquid state, comprising a step of setting a set pressure of the LNG storage tank at a pressure greater than 0.25 bar to 2 bar according to the volume of the LNG in the LNG storage tank while discharging a constant amount of boil-off gas from the LNG storage tank, wherein a uniform temperature distribution is maintained in the LNG storage tank by spraying the LNG from a lower portion of the tank toward boil-off gas at an upper portion of the LNG storage tank and injecting the boil off gas into the LNG at the lower portion of the LNG storage tank, and wherein the amount of boil-off gas that is discharged is regulated as a function of the level of LNG in the LNG storage tank, wherein the level of LNG in the LNG storage tank is calculated by measuring the flow rate of fuel gas supplied from the LNG storage tank to a fuel gas supply line to a fuel gas propulsion means, and wherein the flow rate of fuel gas is measured by a flow rate measurer within the fuel gas supply line.

9. The method according to claim 8, wherein the amount of boil-off gas discharged corresponds to a treatment capacity of the reliquefaction plant.

10. The method according to claim 1, further comprising the step of measuring the composition of the boil-off gas by gas chromatography.

11. The method according to claim 1, further comprising the step of selecting measurement values according to the flow rate of the fuel gas.

12. The method according to claim 1, further comprising the step of compressing boil-off gas within the fuel gas supply line.

13. The method according to claim 12, further comprising the step of storing boil-off gas compressed within the fuel gas supply line.

14. The method according to claim 1, further comprising the step of gasifying LNG from the LNG storage tank and delivering the gasified LNG as a fuel gas to the fuel gas propulsion means.

15. The method according to claim 5, further comprising the step of exchanging heat of the boil off gas in the boil-off gas compression unit with the LNG of the fuel gas supply line.

16. The method according to claim 1, further comprising the step of extracting LNG from the LNG storage tank and compressing the extracted LNG to meet the flow rate and pressure demands of the fuel gas propulsion means.

17. The method according to claim 1, further comprising the step of exchanging heat between the boil-off gas from the LNG storage tank with LNG in the fuel gas supply line.

18. The method according to claim 17, further comprising the step of pumping LNG in the fuel gas supply line to the fuel gas propulsion means.

19. The method according to claim 17, further comprising the step of heating LNG in the fuel gas supply line to supply the fuel gas propulsion means.

* * * * *